US011772147B2

(12) United States Patent
Tabata et al.

(10) Patent No.: US 11,772,147 B2
(45) Date of Patent: Oct. 3, 2023

(54) STRETCH FLANGING TOOL, STRETCH FLANGING METHOD USING THE SAME, AND MEMBER WITH STRETCH FLANGE

(71) Applicant: NIPPON STEEL CORPORATION, Tokyo (JP)

(72) Inventors: Ryo Tabata, Tokyo (JP); Masahiro Saito, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 180 days.

(21) Appl. No.: 17/259,497

(22) PCT Filed: Jul. 31, 2018

(86) PCT No.: PCT/JP2018/028733
§ 371 (c)(1),
(2) Date: Jan. 11, 2021

(87) PCT Pub. No.: WO2020/026356
PCT Pub. Date: Feb. 6, 2020

(65) Prior Publication Data
US 2021/0268566 A1 Sep. 2, 2021

(51) Int. Cl.
*B21D 19/08* (2006.01)

(52) U.S. Cl.
CPC ..... *B21D 19/082* (2013.01)

(58) Field of Classification Search
CPC ..... B21D 11/02; B21D 19/08; B21D 19/082; B21D 22/00; B21D 37/10; B21D 22/26
(Continued)

(56) References Cited

U.S. PATENT DOCUMENTS 2,485,649 A * 10/1949 Norquist ..... B65D 25/14 72/381
5,211,047 A * 5/1993 Kaneyuki ..... B21D 53/88 72/347

(Continued)

FOREIGN PATENT DOCUMENTS

JP 2017-148847 A 8/2017
WO WO 2014/017436 A1 1/2014

OTHER PUBLICATIONS

JP 6027425A, Kanbara et al. Feb. 1985.*

(Continued)

*Primary Examiner* — Edward T Tolan
(74) *Attorney, Agent, or Firm* — Birch, Stewart, Kolasch & Birch, LLP

(57) ABSTRACT

A strength flanging method which improves the method of stretch flanging by press forming so as to disperse strain generated during a forming operation in a blank and in turn prevent the formation of cracks at the center of an arc part, which strength flanging method performs stretch flanging using a stretch flanging tool provided with a top surface part having a protruding part in a top view, straight wall parts, a main slanted wall part between the top surface part and the straight wall parts positioned forming an angle with the top surface part of more than 0° and less than 90° and with the straight wall parts of 10° or more and less than 90° and having two intersecting ridgelines at the straight wall part sides, a first sub slanted wall part sharing one ridgeline among the two ridgelines with the main slanted wall part and positioned forming angles with the top surface part and a straight wall part of more than 0° and less than 90°, and a second sub slanted wall part sharing the other ridgeline among the two ridgelines with the main slanted wall part and (Continued)

positioned forming angles with the top surface part and a straight wall part of more than 0° and less than 90°.

19 Claims, 10 Drawing Sheets

(58) Field of Classification Search
USPC ..... 72/381, 462
See application file for complete search history.

(56) References Cited

U.S. PATENT DOCUMENTS

| | | | | |
|---|---|---|---|---|
| 2011/0048091 | A1* | 3/2011 | Kleber | B21D 53/88<br>72/60 |
| 2018/0043413 | A1* | 2/2018 | Ueno | B21D 19/08 |

OTHER PUBLICATIONS

JP 58-103919A, Sudo Jun. 1983.*
EP 916429A1, Habraken May 1999.*
JP 57-124526A, Matsushima et al. Aug. 1982.*

* cited by examiner (a)

(b)

STRETCH FLANGING TOOL, STRETCH FLANGING METHOD USING THE SAME, AND MEMBER WITH STRETCH FLANGE

FIELD

The present invention relates to a stretch flanging technique obtained by press-forming a member for automobile use etc., in particular relates to a stretch flanging tool, a stretch flanging method using the same, and a member with a stretch flange.

BACKGROUND

In recent years, for the purpose of improving the fuel efficiency and collision safety of automobiles, high strength steel sheet has been increasingly used. Members for automobile use are sometimes required to be formed into complicated shapes. Excellent workability, that is, stretch flangeability, has become important.

Stretch flanging is a working method using a pad and punch to clamp a blank, which had been rendered a predetermined shape in advance by punching or cutting, pressing the die against the portion of the blank to be worked (for example, the circumferential edge part), making the pad and punch clamping the blank move relatively while maintaining that state, and bending and enlarging the part contacting the die in the width direction of the blank. Due to this, a stretch flange is formed sticking out in a direction opposite to the direction in which the punch is pressed into the blank.

The thickness of the stretch flange formed is smallest at regions of contact with the die, then becomes thinner the closer in the noncontact regions to the regions of contact. This phenomenon is due to the degree of working being large at the time of stretch flanging in these regions and in turn the deformation being large. For this reason, when forming a worked portion before working into a predetermined flange by stretch flanging, in particular cracks sometimes form at the center of the arc part of the flange rising vertically from near the base of the stretch flange (bent portion).

For this reason, art for working a formed part with a flange which prevents cracking of the stretch flange by improving the shape of the tool used for bending has been proposed (for example, PTL 1).

CITATIONS LIST

Patent Literature

[PTL 1] WO2014/017436

SUMMARY

Technical Problem

In the art disclosed on PTL 1, during the forming operation, the timing of bringing the curved part of the blank into contact with the die part is delayed to disperse the accumulation of strain at the curved part and thereby prevent cracking of the stretch flange. However, in this art, the relief parts of the die are formed on a single surface (see PTL 1, FIGS. 3A and 3B), so the amount of strain formed in the blank during the forming operation and the range of dispersion of the strain are limited.

The present invention was made in consideration of the above situation and has as its object to provide a stretch flanging tool and stretch flanging method using the same which improve the technique of stretch flanging by press forming so as to disperse the strain generated during the forming operation in the blank and prevent the formation of cracks at the center of the arc part of the flange. Further, the present invention has as its object the provision of a member with a stretch flange, obtained by such a working method, free of cracking at the center of the arc part of the flange.

Solution to Problem

The inventors intensively studied a method of stretch flanging high strength steel sheet which causes the strain generated in the blank during a forming operation to disperse to thereby prevent cracking at the time of a forming operation.

The inventors took note of the fact that, in the past, at the time of stretch flanging bending a blank in the width direction, the part of the blank contacting the die concentrated at the center part of curvature of the blank and that high local surface pressure occurred at that part whereby the strain concentrated and cracking occurred. As a result of their studies, the inventors obtained the finding that unlike the past, by providing parts contacting the die on the blank (that is, high surface pressure parts) at a plurality of locations at the time of stretch flanging to disperse the strain during formation, it is possible to prevent the generation of local strain at the blank and prevent cracking at the time of working (finding 1).

Further, the inventors obtained the finding that when stretch flanging to bend a blank in its width direction, dispersing the strain generated at the contact parts over a broader range at the initial stage can efficiently prevent cracking at the time of working as a whole compared with dispersing the strain generated at the contact parts at a later stage (finding 2).

The present invention is art based on these findings 1 and 2 efficiently dispersing strain generated at a blank at the time of flanging to prevent the occurrence of cracking at a high level and has as its gist the following:

(1) A stretch flanging tool comprising a top surface part having a protruding part in a top view, straight wall parts, a main slanted wall part, the main slanted wall part positioned between the top surface part and the straight wall parts, the main slanted wall part forming an angle with the top surface part of more than 0° and less than 90° and with the straight wall parts of 10° or more and less than 90°, the main slanted wall part having two ridgelines intersecting at the straight wall part sides, a first sub slanted wall part, the first sub slanted wall part sharing one ridgeline among the two ridgelines with the main slanted wall part, the first sub slanted wall part forming angles with the top surface part and a straight wall part of more than 0° and less than 90°, and a second sub slanted wall part, the second sub slanted wall part sharing the other ridgeline among the two ridgelines with the main slanted wall part, the second sub slanted part forming angles with the top surface part and a straight wall part of more than 0° and less than 90°.

(2) The stretch flanging tool according to (1), wherein an opening angle of the two ridgelines with respect to a side shared by the main slanted wall part and the top surface part is 45 to 90°.

(3) The stretch flanging tool according to (1) or (2), wherein an angle θ of the main slanted wall part with respect to the straight wall parts is 10 to 45°.

(4) The stretch flanging tool according to any one of (1) to (3), wherein a radius of curvature of the two ridgelines is 15 mm or less.

(5) The stretch flanging tool according to any one of (1) to (4), wherein in a front view, the two ridgelines being convex with respect to the sub slanted wall parts.

(6) The stretch flanging tool according to any one of (1) to (5), wherein a vertical direction dimension S of the main slanted wall part, a slant angle θ of the main slanted wall part with respect to a vertical direction, a horizontal direction protrusion dimension "h" of the blank from the punch and pad, and a horizontal direction dimension "c" from the pad and punch satisfy the relationship:

$$S \leq (h-c)/\tan\theta.$$

(7) The stretch flanging tool according to any one of (1) to (6), wherein the first sub slanted wall part and/or the second sub slanted wall part further comprises one or more ridgelines.

(8) The stretch flanging tool according to (7), wherein the ridgeline further provided on the first sub slanted wall part and/or the second sub slanted wall part comprises intersects with the ridgeline shared by the main slanted wall part and the first sub slanted wall part or the second sub slanted wall part.

(9) A stretch flanging method using a stretch flanging tool according to any one of (1) to (8) to form a member having a stretch flange part, the stretch flanging method comprising a step of bending a blank along the two or more ridgelines and a step of bending the blank along ridgelines of the straight wall parts.

(10) A member with a stretch flange comprising a top plate part having an outer circumferential edge bent to the inside to form a recess and a stretch flange part having a curved part and noncurved part connected in a state bent with respect to the top plate part, a Vickers hardness of a range is larger than 10 (HV) or more than the Vickers hardness of the top plate part, the range positioned at a distance of 50% or more and 150% or less of a length in a height direction of the stretch flange in a direction of extension of the noncurved part from a boundary of the curved part and noncurved part of the stretch flange.

Advantageous Effects of Invention

In the forming tool according to the present invention and the forming method using the same, the forming process is divided into two stages and the strain generated in the blank at the initial stage of the forming process is dispersed. According to the forming technique according to the present invention, by dispersing the contact parts between the blank and die, that is, the high surface pressure parts, at the initial stage of the stretch flanging, it is possible to prevent the generation of local strain in the blank and in turn prevent cracking at the time of working.

DESCRIPTION OF EMBODIMENTS

Stretch Flanging Tool and Stretch Flanging Method

Basic Aspect

Below, a basic aspect of the stretch flanging tool and stretch flanging method according to the present embodiment will be explained.

Figure 1:
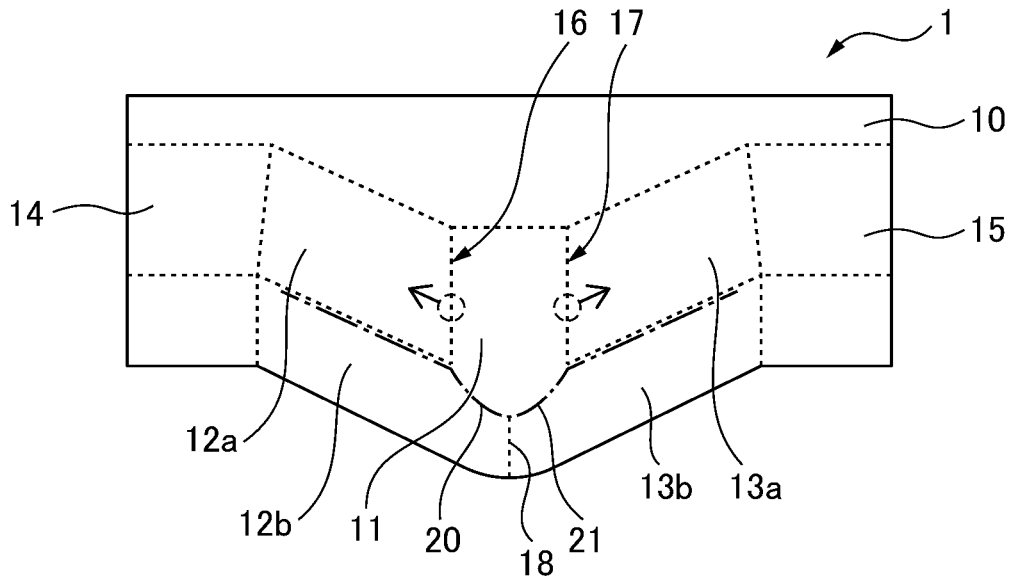
FIGS. 1A and 1B are views showing a forming tool (die) according to the present embodiment.
Figure 1:
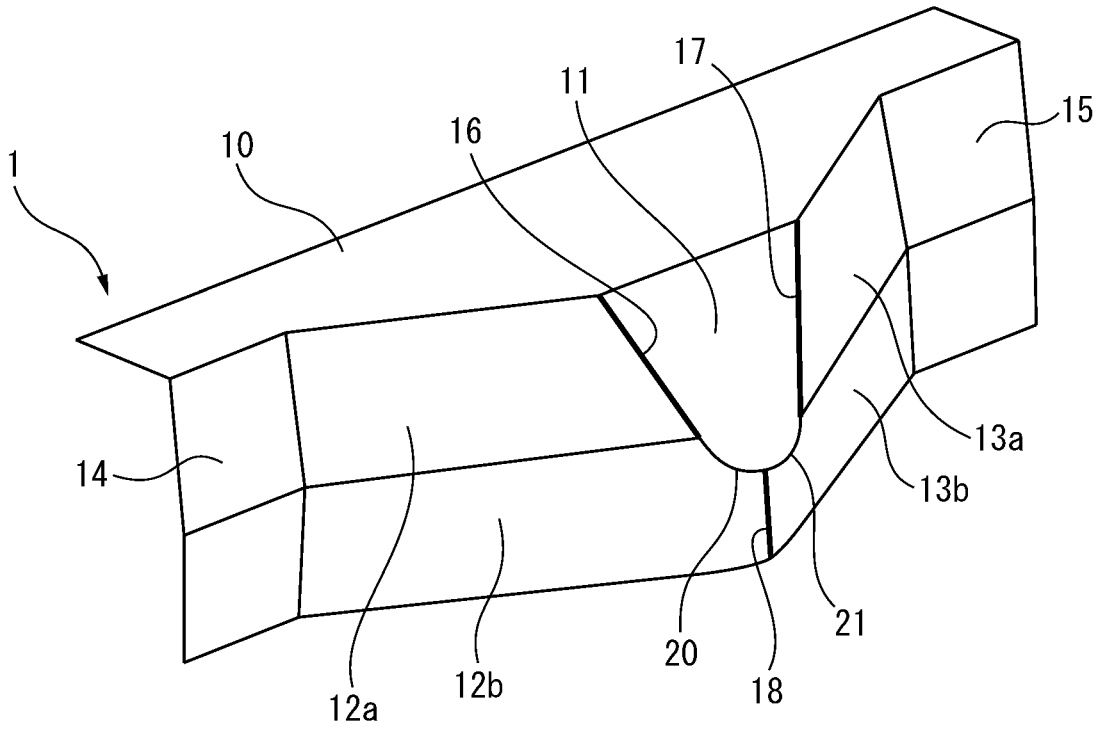

FIGS. 1A and 1B are views showing a stretch flanging tool (die) according to the present embodiment, wherein FIG. 1A is a perspective view from the top in the front direction and FIG. 1B is a perspective view from a slanted direction.

The stretch flanging tool (below, simply referred to as the "forming tool") 1 shown in FIGS. 1A and 1B has a protruding part of the center part in the longitudinal direction protruding curved in a direction vertical to the longitudinal direction. This part forms a forming part (main slanted wall part 11, first sub slanted wall part 12*a*, second sub slanted wall part 13*a*, straight wall part 12*b*, and straight wall part 13*b*) comprised of a contact part with a blank having a constriction at the center part. Further, at the two sides in the longitudinal direction of the forming part, nonforming parts 14 and 15 not contacting the blank continue from the forming part.

The main slanted wall part 11 and forming part are positioned at the top in the vertical direction in FIGS. 1A and 1B and are provided with the main slanted wall part 11 connected to the top surface part 10, the first sub slanted wall part 12*a*, the second sub slanted wall part 13*a*, and the straight wall part 12*b* and straight wall part 13*b* respectively connected to the first sub slanted wall part 12*a* and second sub slanted wall part 13*a* below them in the vertical direction. The top surface part 10 and the main slanted wall part 11, first sub slanted wall part 12*a*, and second sub slanted wall part 13*a* are positioned adjoining each other forming angles of respectively more than 0° and less than 90°, preferably more than 0° and 80° or less. The first sub slanted wall part 12*a* and straight wall part 12*b* and the second sub slanted wall part 13*a* and straight wall part 13*b* are positioned adjoining each other forming angles of respectively more than 0° and less than 90°. The main slanted wall part 11 and straight wall parts are positioned adjoining each other forming angles of 10° or more and less than 90°. The straight wall parts have surfaces parallel to the direction of relative movement of the die and punch. Here, the angle formed by one surface and other means the angle of the acute angle side formed by the surfaces extended from these surfaces.

Note that, for convenience, the top surface part 10 is explained as one being horizontal to the topmost surface of the stretch flanging tool, but this does not limit the orientation of the forming tool at the time actual stretch flanging. In stretch flanging, the die and punch may move relatively. For example, an arrangement where the top surface part 10 becomes the bottommost surface is also naturally possible.

The differentiation of the slanted wall parts and straight wall parts also stands at the nonforming parts 14 and 15.

The main slanted wall part 11 extends from the top surface part 10 at a position away from the center of curvature in the circumferential direction and is provided with two intersecting ridgelines 16 and 17 at the straight wall parts 12*b* and 13*b* sides.

Here, the ridgeline 16 is a line at the boundary of the main slanted wall part 11 and the first sub slanted wall part 12*a* connecting parts with the smallest radius of curvature at the boundary and is a line connecting peak to peak. Similarly, the ridgeline 17 is a line at the boundary of the main slanted wall part 11 and the second sub slanted wall part 13*a* connecting parts with the smallest radius of curvature of boundary and is a line connecting peak to peak.

The straight wall parts 12*b* and 13*b* are provided with a shared ridgeline 18 at their boundary. The ridgeline 18 is a line at the boundary of the straight wall part 12*b* and the straight wall part 13*b*, at least part of which forms a curved surface, connecting parts with the smallest radii of curvature and is a line connecting peak to peak. The ridgelines of the straight wall parts 12*b* and 13*b* may be provided with further different ridgelines in addition to the shared ridgeline 18.

In the forming tool according to the present embodiment, the ridgeline 16 and ridgeline 17 converge into one at the straight wall part side. That is, as shown in FIGS. 1A and 1B, the adjoining two ridgelines 16 and 17, parts 20 and 21 of the boundary lines between the main slanted wall part 11 and straight wall parts 12*b* and 13*b*, and the ridgeline 18 are formed connected in that order.

The forming tool according to the present embodiment is shaped having the three slanted walls of a main slanted wall part 11 surrounded by the ridgelines 16 and 17, a first sub slanted wall part 12*a* sharing the ridgeline 16 with the main slanted wall part 11, and a second sub slanted wall part 13*a* sharing the ridgeline 17 with the main slanted wall part 11. By making the die 1 such a shape, it becomes possible to make the strain generated at the blank during a flanging operation efficiently disperse over a broad range and prevent formation of cracks at a high level.

Figure 2:
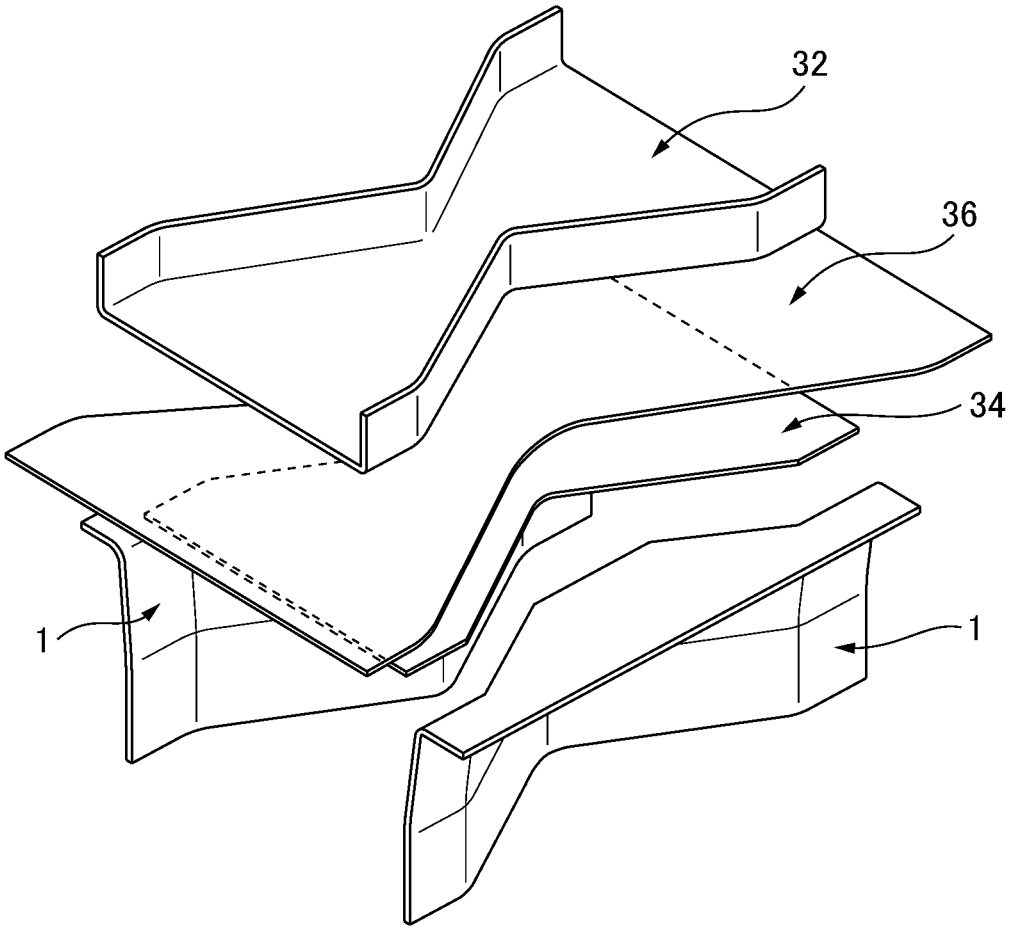
FIG. 2 is a schematic view at the time of using a forming pad (die), punch, and pad shown in FIGS. 1A and 1B to stretch flange a blank.

The stretch flanging using the forming tool shown above is performed as follows:

FIG. 2 is a schematic view showing an example of stretch flanging a blank 36 using forming tools (dies 1) shown in FIGS. 1A and 1B and a punch 32 and pad 34. In the illustrated example, the punch 32 and pad 34 are used to clamp the blank 36. In that state the two ends of the blank 36 are respectively placed on the top surfaces of the dies 1 and 1. Next, the punch 32 and the pad 34 are pulled down downward in the vertical direction for stretch flanging.

In such stretch flanging, due to the ridgeline unit where the ridgelines 16 and 17 are converge into the common ridgeline 18 of the straight wall parts 12*b* and 13*b* through the ridgeline 20 forming the boundary between the main slanted wall part 11 and the straight wall part 12*b* and the ridgeline 21 forming the boundary between the main slanted wall part 11 and the straight wall part 13*b*, the state of contact of the forming tools and the blank changes along with the elapse of time.

First, at the initial stage of stretch flanging, the ridgelines 16 and 17 surrounding the main slanted wall part 11 and provided at positions away from the center of the curved part in a top view of the forming tool in the circumferential direction contact the blank. Specifically, the specific parts of the blank successively contact the ridgelines 16 and 17. Due to this, the blank is curved to the outside of the plane along the main slanted wall part 11 and is locally deformed by tension by receiving the high surface pressure at the successively changing specific parts.

Next, at the middle stage of stretch flanging, the ridgeline 20 forming the boundary of the main slanted wall part 11 and the straight wall part 12*b* and the ridgeline 21 forming the boundary of the main slanted wall part 11 and the straight wall part 13*b* contact the blank. Specifically, specific parts of the blank successively contact the ridgelines 20 and 21. Due to this, the blank is curved to the outside of the plane along the ridgelines 20 and 21 and is locally deformed by tension by receiving the high surface pressure at the successively changing specific parts.

Finally, at the latter stage of stretch flanging, the ridgeline 18 formed by the straight wall parts 12*b* and 13*b* and provided at the center of the curved part of the forming tool seen in a top view contacts the blank. Specifically, specific parts of the blank successively contact the ridgelines formed from the topmost parts to the bottommost parts of the straight wall parts 12*b* and 13*b* in the vertical direction. Due to this, the blank is curved to the outside of the plane along the straight wall parts 12*b* and 13*b* and is locally deformed by tension by receiving the high surface pressure at the successively changing specific parts.

In stretch flanging using the above such forming tool (die 1), at the initial stage of stretch flanging, by providing two contact parts between the blank and forming tool (ridgelines 16 and 17), it is possible to cause tensile deformation in the direction of curvature of the blank (circumferential direction) over a broad range and disperse the strain at a high level.

The blank after such deformation behavior then successively makes the contact part with the ridgeline 18 of the straight wall parts 12*b* and 13*b* move through part of the boundary line between the main slanted wall part 11 and the straight wall part 12*b* (ridgeline 20) and part of the boundary line between the main slanted wall part 11 and the straight wall part 13*b* (ridgeline 21). Due to this, as explained above, since the strain is sufficiently made to disperse at the initial stage of forming, even if employing deformation behavior the same as the past at the latter stage of forming, it is possible to reduce the concentration of strain at specific parts at a high level. Therefore, according to the stretch flanging technique of the present embodiment, it is possible to provide a member with a stretch flange free of cracks at the center of the arc part of the blank.

Additional Aspects

Next, Additional Aspects 1 to 4 able to be selectively worked with respect to the basic aspect of the stretch flanging method and forming tool according to the present embodiment will be explained.

Additional Aspect 1

Figure 3:
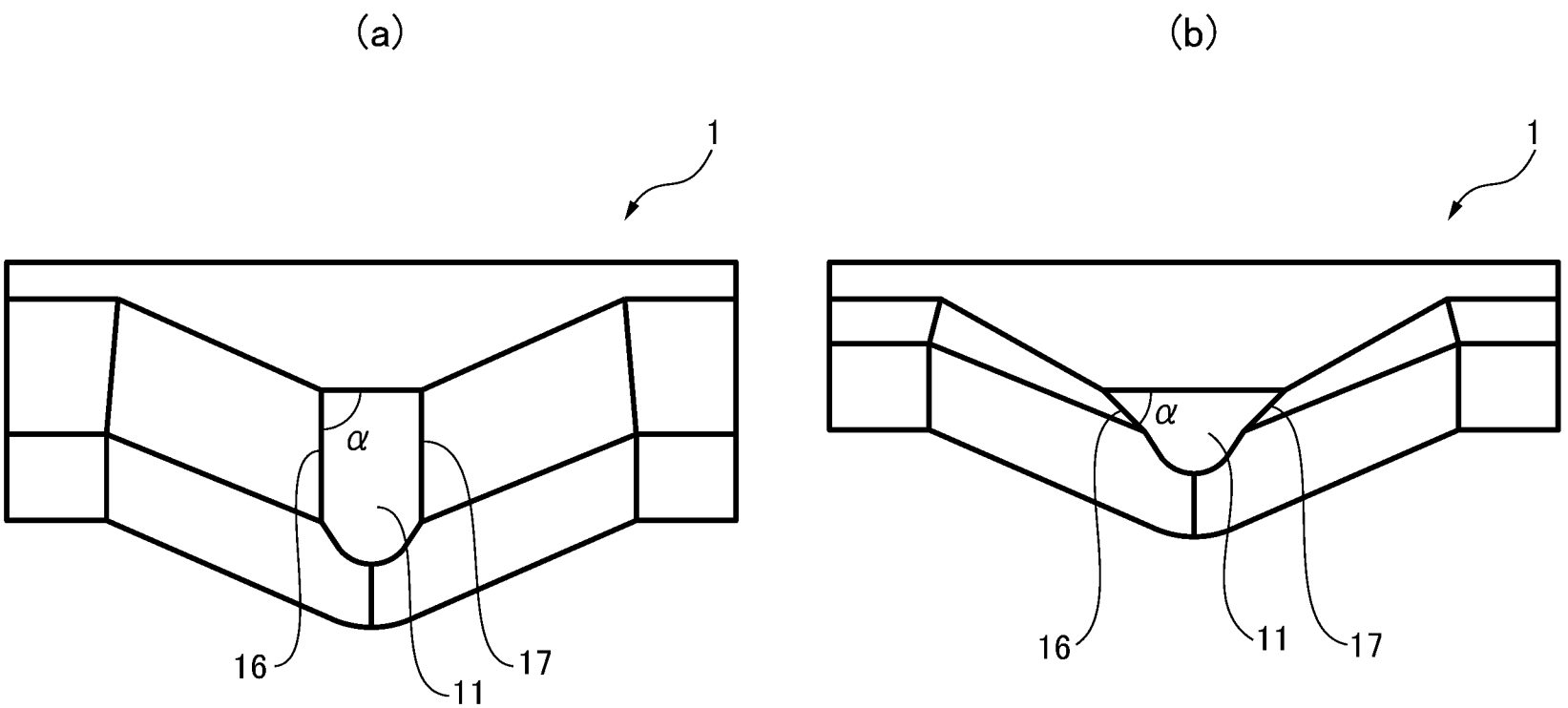
FIGS. 3A and 3B are perspective views showing an opening angle α of a ridgeline of a slanted wall part with respect to the horizontal direction.

In the basic aspect, the opening angles of the ridgeline 16 and ridgeline 17 with respect to the side shared by the main slanted wall part and the top surface part are preferably 45° or more and 90° or less (Additional Aspect 1). FIGS. 3A and 3B are perspective views showing the opening angle α of the ridgeline 16 with respect to the horizontal direction, wherein FIG. 3A shows the case where the opening angle α is 90° and FIG. 3B shows the case where the opening angle α is 45°.

To reduce the opening angles α, it is possible to sufficiently secure the distance between the ridgelines 16 and 17 and impart a broad contact range between the blank and ridgelines in the circumferential direction. If the opening angles α are 45° or more, it is possible to define the shape of the main slanted wall part 11 and further the first sub slanted wall part 12*a* and the second sub slanted wall part 13*a* in a range not excessively enlarging the slant angle of the main slanted wall part 11 with respect to the vertical direction (later explained slant angle θ: see FIGS. 4A and 4B).

Note that, by increasing the opening angles α to thereby make the distance between the ridgelines 16 and 17 smaller and make the range of contact of the blank and ridgeline narrower, it is possible to form the flange part without the occurrence of excessive concentration of strain near the center of the curved part of the blank. If the opening angles α are 90° or less, that effect is exhibited at a high level.

If making the opening angles α 45° or more and 80° or less, it is possible to form a flange part without causing excessive concentration of strain near the center of the curved part of the blank at a high level, while if making them 45° or more and 70° or less, it is possible to form a flange part without causing excessive concentration of strain near the center of the curved part of the blank at a high level. Note that, the opening angles of the ridgelines 16 and 17 with respect to the horizontal direction do not have to be equal values. They may be suitably adjusted by the shape of the flange to be formed.

Additional Aspect 2

Figure 4:
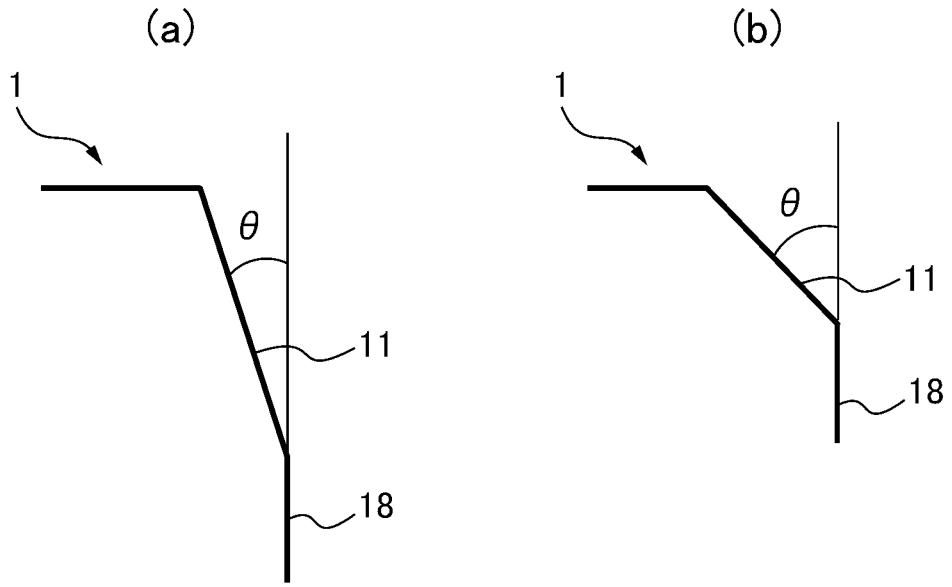
FIGS. 4A and 4B are side views showing a slant angle θ of a ridgeline of a slanted wall part with respect to the vertical direction.

In the basic aspect and the aspect of this basic aspect combined with Additional Aspect 1, the slant angle (angle formed by straight wall part) of the main slanted wall part 11 with respect to the ridgeline 18 shared by the straight wall parts 12*b* and 13*b* is preferably 10° or more and 45° or less (Additional Aspect 2). FIGS. 4A and 4B are side views showing of the slant angle (angle formed by straight wall part) θ of the main slanted wall part with respect to the vertical direction, wherein FIG. 4A shows the case where the slant angle θ is 10° while FIG. 4B shows the case where the slant angle θ is 45°.

By making the slant angle θ of the main slanted wall part 11 with respect to the vertical direction 45° or less, the slant of the main slanted wall part becomes sharp and it becomes possible to secure a large amount of bending deformation at the time of end of contact of the blank with the ridgeline. Due to this, it is possible to relatively reduce the amount of bending deformation due to contact of the ridgeline 18 provided at the straight wall parts 12*b* and 13*b* with the blank. At the time of the forming operation by the straight wall parts 12*b* and 13*b*, due to the contact with the ridgeline 18 corresponding to the center of constriction of the blank, strain is particularly greatly formed at the blank, but according to the present embodiment, it is possible to keep down the amount of bending deformation due to contact of the ridgeline 18 and further efficiently prevent cracking.

On the other hand, by making the slant angle θ of the main slanted wall part 11 with the ridgeline 18 shared by the straight wall parts 12*b* and 13*b* 10° or more, the slant of the main slanted wall part 11 becomes gentle and the opening angles α of the ridgeline 16 and ridgeline 17 with the horizontal direction can be sufficiently secured.

The reason is that if making the slant angle θ less than 10°, then making the opening angles α 90° or less, to position the ridgelines 16 and 17 sufficiently away from the center of curvature of the blank in the circumferential direction, the slant angles θ of the first sub slanted wall part 12*a* and second sub slanted wall part 13*a* with respect to the vertical direction become negative angles. If the slant angles θ are negative angles, the blank can no longer be made to contact in stages the ridgeline 18 shared by the straight wall parts 12*b* and 13*b* from the first sub slanted wall part 12*a* and the second sub slanted wall part 13*a* so as to impart bending deformation, so the slant angles θ have to be made positive angles.

If making the slant angle θ 15° or more and 40° or less, it is possible to make the amount of bending deformation at the time of the end of contact of the blank with the ridgeline larger while keeping down the amount of bending deformation due to contact with the ridgeline 18 and efficiently prevent cracking, while if making it 15° or more and 35° or less, it is possible to make the amount of bending deformation at the time of the end of contact of the blank with the ridgeline larger at an extremely high level while keeping down the amount of bending deformation due to contact with the ridgeline 18 and efficiently prevent cracking.

Additional Aspect 3

Figure 5:
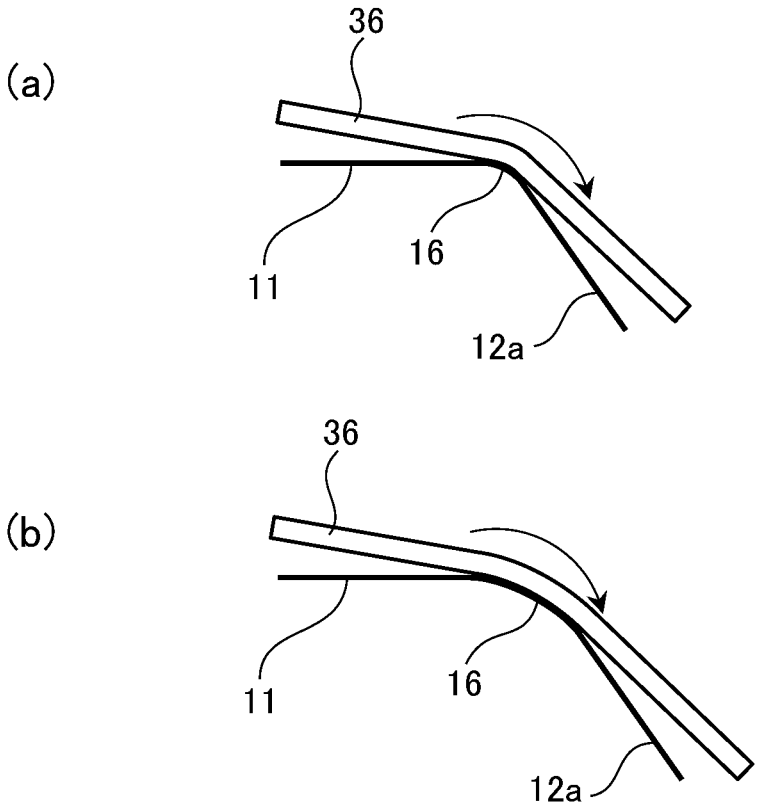
FIGS. 5A and 5B are cross-sectional views showing the state of contact of the blank and ridgeline when viewed from the top.
Figure 6:
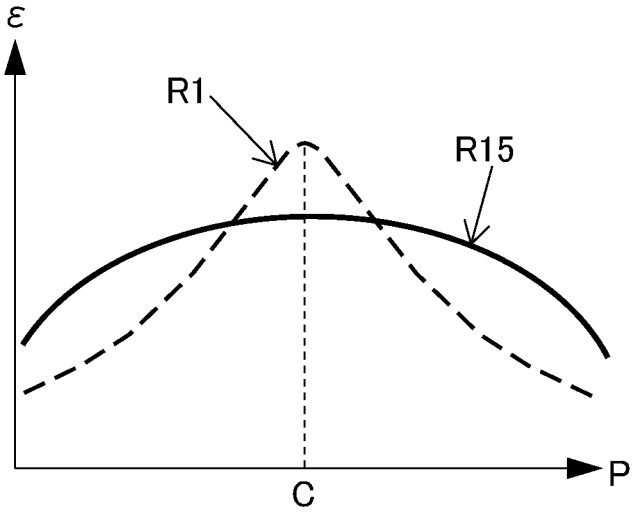
FIG. 6 is a graph showing the relationship between the amount of strain and the distance from the position of contact C of the blank (center position in direction of curvature of blank) and ridgeline in the case of making the radius of curvature of the ridgeline 1 mm and 15 mm.

In the basic aspect and the aspect of this basic aspect combined with at least one of the Additional Aspects 1 and 2, the radii of curvature at the contact points of the ridgelines 16 and 17 of the slanted wall part with the top surface part 10 are preferably 1 mm or more and 15 mm or less (Additional Aspect 3). FIGS. 5A and 5B are cross-sectional views (top views) showing states of contact of the blank and ridgeline 16, where FIG. 5A shows the state where the radius of curvature of the ridgeline 16 is 1 mm and FIG. 5B shows the case where the radius of curvature of the ridgeline 16 is 15 mm. FIG. 6 is a graph showing the relationship between the amount of strain ε in the circumferential direction and the distance P from the contact position C of the blank and ridgeline 16 (center position in direction of curvature of blank) when making the radii of curvature of the ridgelines 16 and 17 1 mm (R1) and 15 mm (R15). Note that, the amount of strain in FIG. 6 is the amount of strain in case of applying the same amounts of load to the punch and pad.

Here, the "radius of curvature of the ridgeline", as shown in FIGS. 5A and 5B, means the radius of curvature at the intersection of the main slanted wall part and the sub slanted wall part, which becomes a straight lines in the cross-sectional view, and is not the curvature of the ridgeline itself.

As shown in FIG. 5A, if the radius of curvature of the ridgeline 16 is small (R1), the contact area of the blank 36 and the ridgeline 16 is relatively small, while as shown in FIG. 5B, if the radius of curvature of the ridgeline 16 is large (R15), the contact area of the blank 36 and the ridgeline 16 is relatively large. For this reason, as shown in FIG. 6, if the radius of curvature is large (R15), compared to if the radius of curvature is small (R1), it is possible to impart a large maximum main strain in the circumferential direction over a broad range. Accordingly, the radius of curvature of the ridgeline 16 is preferably 1 mm or more.

As opposed to this, if making the radii of curvature of the ridgelines 16 and 17 excessively large, it is not possible to sufficiently obtain a surface pressure locally acting on the blank 36 and not possible to make the strain of the blank 36 sufficiently disperse toward the circumferential direction. For this reason, the radii of curvature of the ridgelines 16 and 17 are preferably made 15 mm or less.

The above effect is exhibited at a further higher level when the radii of curvature of the ridgelines are 13 mm or less and is exhibited an extremely high level when they are 5 mm or less. Note that, when excessively reducing the radii of curvature of the ridgelines, stretch flanging is liable to become difficult, so the radius of curvature of the first ridgeline has to be at least 1 mm or so.

Additional Aspect 4

Figure 7:
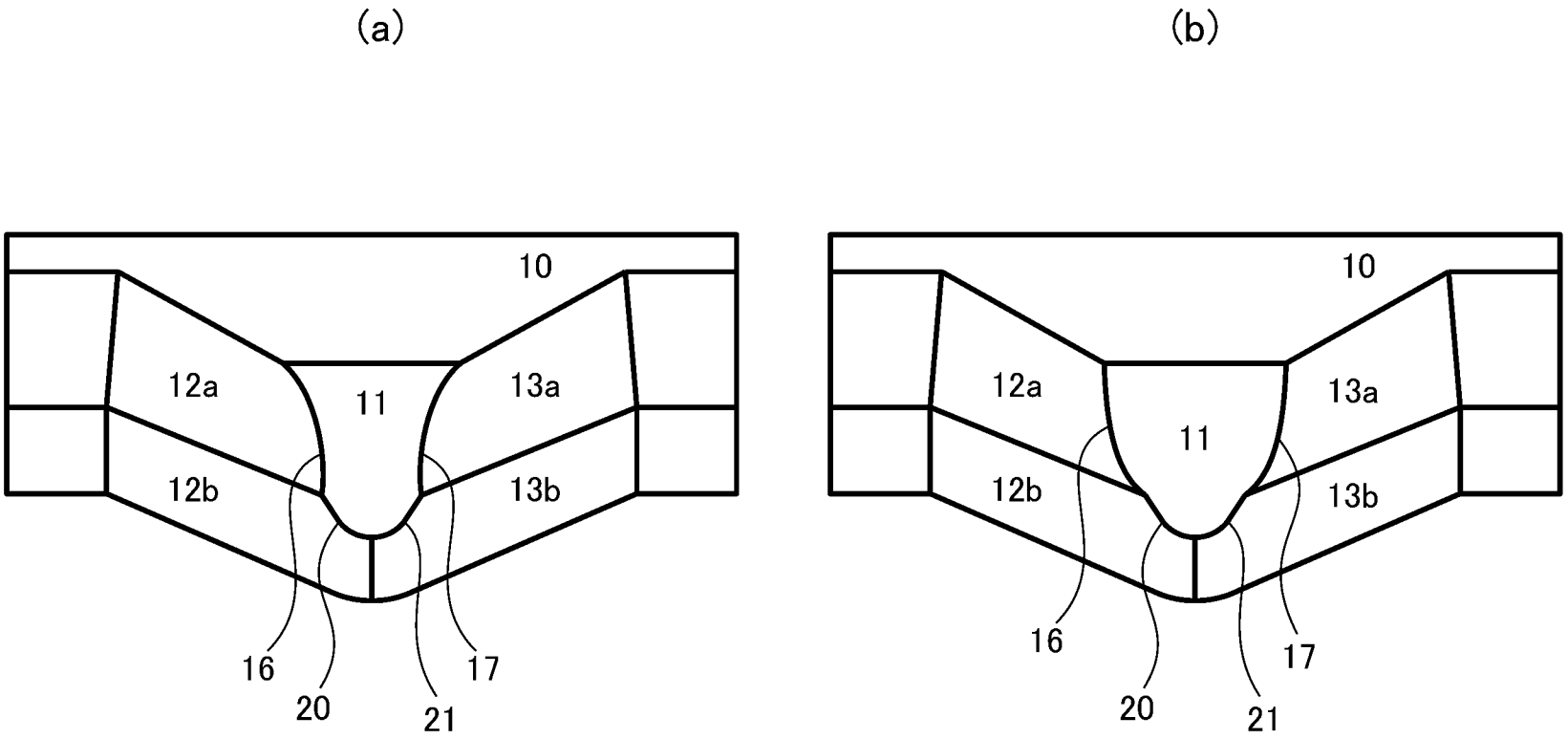
FIGS. 7A and 7B are perspective views showing protruding states of the ridgelines.

In the basic aspect and the aspect of this basic aspect combined with at least one of the Additional Aspects 1 to 3, preferably, in a front view, the ridgelines 16 and 17 surrounding the main slanted wall part 11 protrude from the sub slanted wall parts (Additional Aspect 4). FIGS. 7A and 7B are perspective views showing protruding states of the ridgelines. FIG. 7A shows the case where the ridgelines protrude with respect to the main slanted wall part (are recessed with respect to the sub slanted wall parts), while FIG. 7B shows the case where the ridgelines protrude with respect to the sub slanted wall parts.

In the case shown in FIG. 7A (case where ridgelines 16 and 17 protrude from main slanted wall part), the directions of extension of the connecting part between the ridgeline 16 and the ridgeline 20 forming the boundary of the main slanted wall part 11 and the straight wall part 12*b* and the connecting part between the ridgeline 17 and the ridgeline 21 forming the boundary of the main slanted wall part 11 and the straight wall part 13*b* rapidly change. Further, even if there are no ridgelines 20 and 21, that is, if the ridgelines 16 and 17 are directly connected with the ridgeline 18 without going through the ridgelines 20 and 21, the directions of extension of the connecting parts rapidly change.

As opposed to this, in the case shown in FIG. 7B (case where ridgelines 16 and 17 protrude from sub slanted wall parts), the directions of extension of the connecting part between the ridgeline 16 and the ridgeline 20 forming the boundary of the main slanted wall part 11 and the straight wall part 12*b* and the connecting part between the ridgeline 17 and the ridgeline 21 forming the boundary of the main slanted wall part 11 and the straight wall part 13*b* gently change. Further, even if there are no ridgelines 20 and 21, that is, if the ridgelines 16 and 17 are directly connected with the ridgeline 18 without going through the ridgelines 20 and 21, the directions of extension of the connecting parts gently change.

For this reason, in the case shown in FIG. 7B (case where the ridgelines 16 and 17 protrude with respect to the sub slanted wall parts), compared with the case shown in FIG. 7A (case where ridgelines 16 and 17 protrude upward), strain does not concentratedly remain in the connection parts and in turn it is possible to obtain an excellent effect of dispersion of strain. Therefore, in the case of FIG. 7B (case where the ridgelines 16 and 17 protrude downward), it is possible to prevent the generation of local strain at the blank and in turn further prevent cracking at the time of working.

Additional Aspect 5

In the basic aspect (stretch flanging method) and the aspect of this basic aspect combined with at least one of the Additional Aspects 1 to 4, from a side view, preferably the vertical direction dimension S of the main slanted wall part, the slant angle θ of the main slanted wall part with respect to the vertical direction, the horizontal direction protrusion dimension "h" of the blank from the punch and pad, and the horizontal direction dimension "c" from the punch and pad preferably satisfy the relationship:

$$S \leq (h-c)/\tan\theta \quad (1)$$

Figure 8:
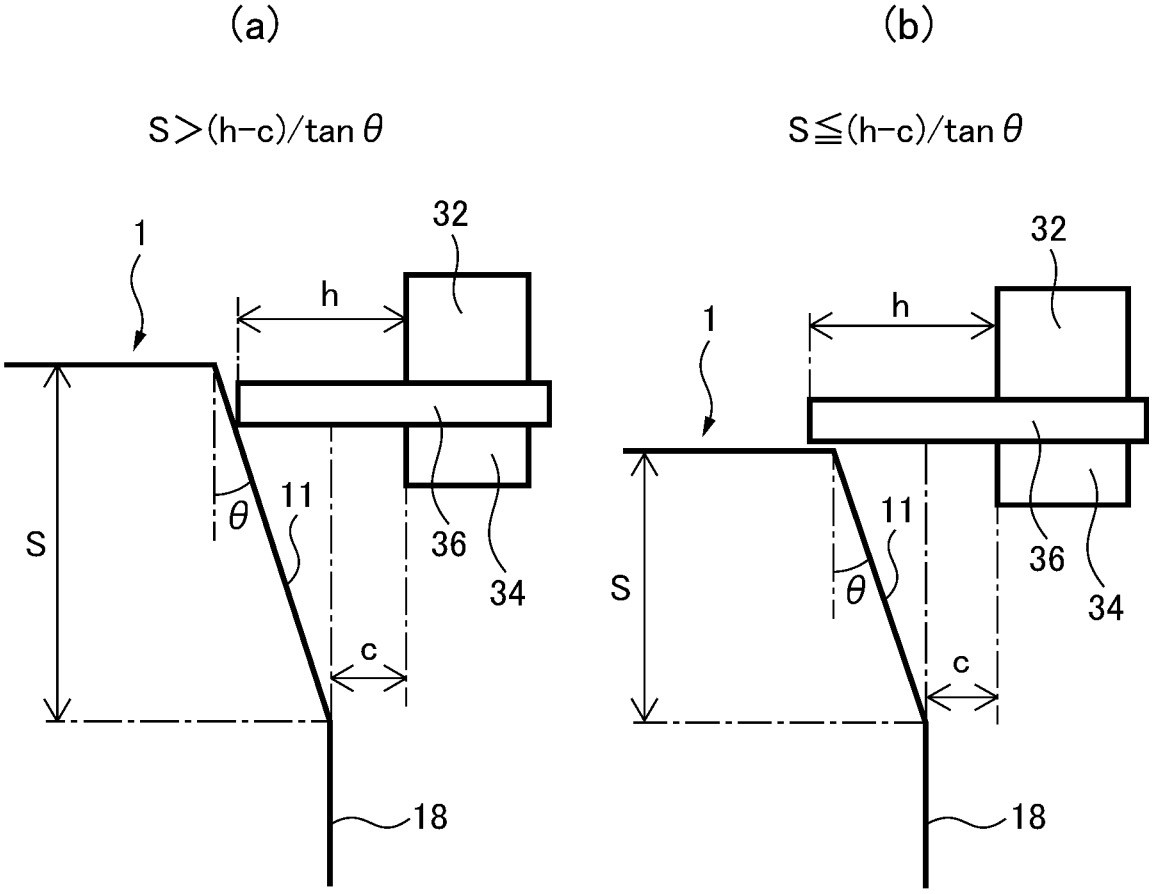
FIGS. 8A and 8B are side views showing the positional relationship between the blank and the forming tools (dies), pad, and punch at the time of start of stretch flanging.

FIGS. 8A and 8B are side views showing the positional relationship between the blank 36 and the forming tool (die 1) and punch 32 and pad 34 at the time of start of stretch flanging. FIGS. 8A and 8B relate to the vertical direction dimension S of the main slanted wall part 11, the slant angle θ of the main slanted wall part with respect to the vertical direction, the horizontal direction protrusion dimension "h" of the blank 36 from the punch 32 and pad 34, and the horizontal direction dimension "c" from the punch 32 and pad 34 to the straight wall part, wherein FIG. 8A shows the case satisfying $S>(h-c)/\tan\theta$ and FIG. 8B shows the case satisfying $S\leq(h-c)/\tan\theta$.

If not satisfying the above formula (1), that is, if the end part of the blank 36 in the horizontal direction abuts against the main slanted wall part 11 from the start of the stretch flanging (FIG. 8A), the damage to the end part will be relatively large. As opposed to this, if satisfying formula (1), that is, if the end part of the blank 36 in the horizontal direction does not abut against the main slanted wall part 11 from the start of the stretch flanging (FIG. 8B), the damage to the end part will be relatively small.

For this reason, the example shown in FIG. 8B is smaller in amount of decrease of deformation ability of the end part of the blank in the horizontal direction compared with the example shown in FIG. 8A. Therefore, if stretch flanging operations were performed from states shown in these two figures, the example shown in FIG. 8B would deform without excessive damage being given near the end part in the horizontal direction in particular of the blank 36, so it is possible to prevent cracking at the time of the forming operation at a further higher level.

Additional Aspect 6

In the basic aspect and the aspect of this basic aspect combined with at least one of the Additional Aspects 1 to 5, the ridgeline of the first sub slanted wall part and the second sub slanted wall part may be provided with further ridgelines in their regions in addition to the ridgelines 16 and 17. The ridgelines do not have to be at symmetric positions at the ridgeline of the first sub slanted wall part and the second sub slanted wall part. There may be different numbers of ridgelines at the respective slanted wall parts.

Figure 9:
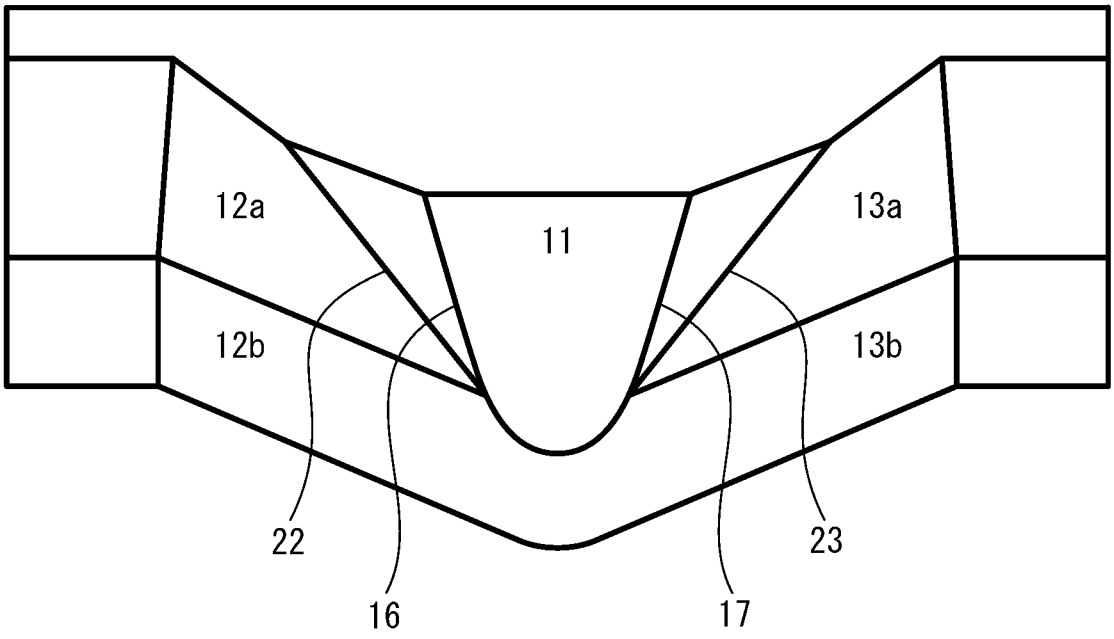
FIG. 9 is a perspective view of an embodiment further provided with two ridgelines in the regions surrounded by the ridgeline of the first sub slanted wall part and the ridgeline of the second sub slanted wall part.

FIG. 9 shows an example of the case where the region of the first sub slanted wall part 12*b* and the region of the second sub slanted wall part 13*b* are respectively provided with ridgelines 22 and 23. In the example shown in FIG. 9, the total number of ridgelines including the ridgelines 16 and 17 is increased to four to therefore obtain a shape having five slanted walls.

Further, in the example shown FIG. 9, the ridgeline 22 and the ridgeline 23 respectively intersect with the ridgelines 16 and 17. As such a configuration, by providing a plurality of contact parts of the blank and forming tool at the start of the forming operation (ridgelines 16, 17, 22, and 23), a plurality of points become starting points of stretch flanging, tensile deformation in the direction of curvature of the blank (circumferential direction) is caused over a broad range, the intervals of positions where a high surface pressure is applied become wider, and the strain can be further made to disperse.

Further, there is no set upper limit on the number of ridgelines provided, but if there are too many ridgelines, the die becomes larger in size and a rise in cost is invited, so the total of the further provided ridgelines is preferably 1 to 4.

Member with Stretch Flange

Figure 10:
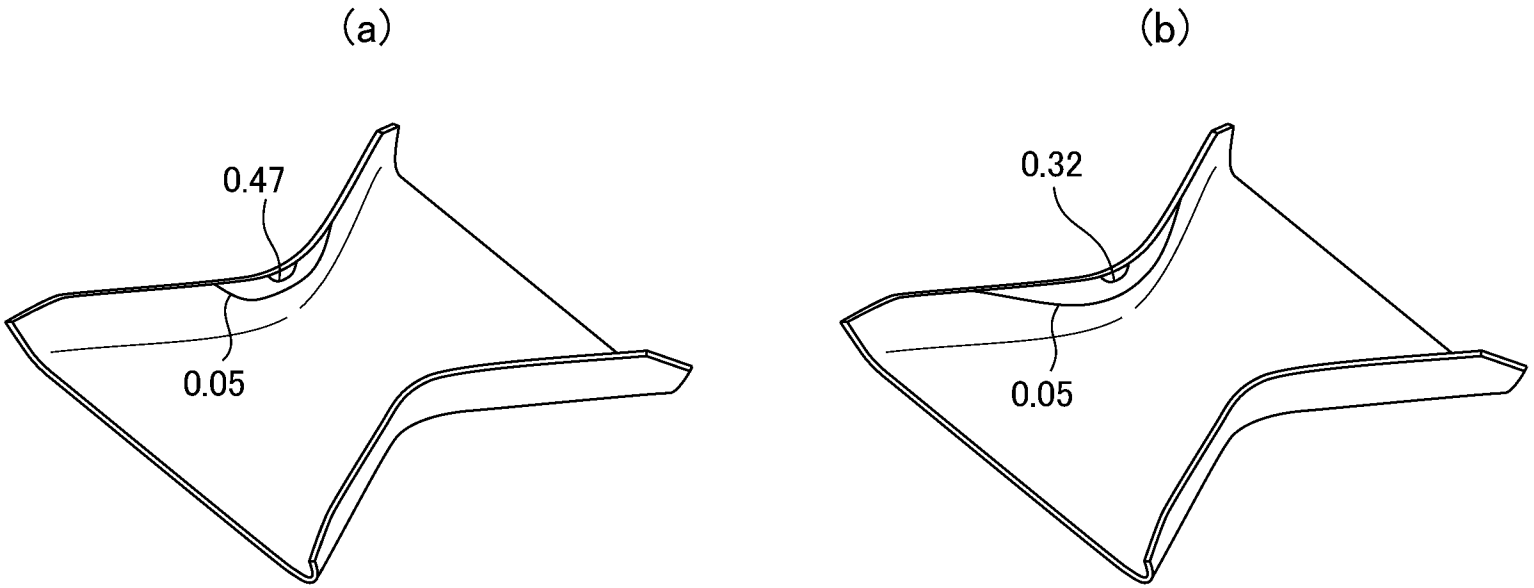
FIGS. 10A and 10B are schematic views showing the results of measurement of the maximum main strain in members with stretch flanges in the case of using 590 MPa class DP steel.

FIGS. 10A and 10B are schematic views showing the results of measurement of the maximum main strain near the center part of curvature of the member with a stretch flange in the case of using a tensile strength 590 MPa class steel sheet, wherein FIG. 10A shows a conventional member with a stretch flange (conventional part) and FIG. 10B shows a member with a stretch flange according to the present embodiment (embodiment part).

Here, the solid lines in the two figures are respectively lines connecting the points at which the same maximum main strain values were measured. Note that, the conventional part shown in FIG. 10A is a member with a stretch flange obtained by the method disclosed in PTL 1 using the set of tools for stretch flanging use disclosed in PTL 1. As opposed to this, the embodiment part shown in FIG. 10B is a member with a stretch flange obtained by the forming method according to the present embodiment using the dies 1 shown in FIGS. 1A and 1B and the punch 32 and pad 34 shown in FIG. 2.

The members with stretch flanges shown in FIGS. 10A and 10B are both common on the point of being provided with a top plate part having an outer circumferential edge curved inward to form a recess and a stretch flange part connected to the top plate part in a bent state.

According to FIGS. 10A and 10B, the fact that a large amount of strain is generated at the center of the curved part of the stretch flange is confirmed in each of the conventional part and the embodiment part. However, it was learned that in the conventional part shown in FIG. 10A, the maximum main strain was 0.47, while the maximum main strain of the embodiment part shown in FIG. 10B was 0.32. For this reason, in the embodiment part, it can be said that the maximum main strain was kept relatively low.

Figure 11:
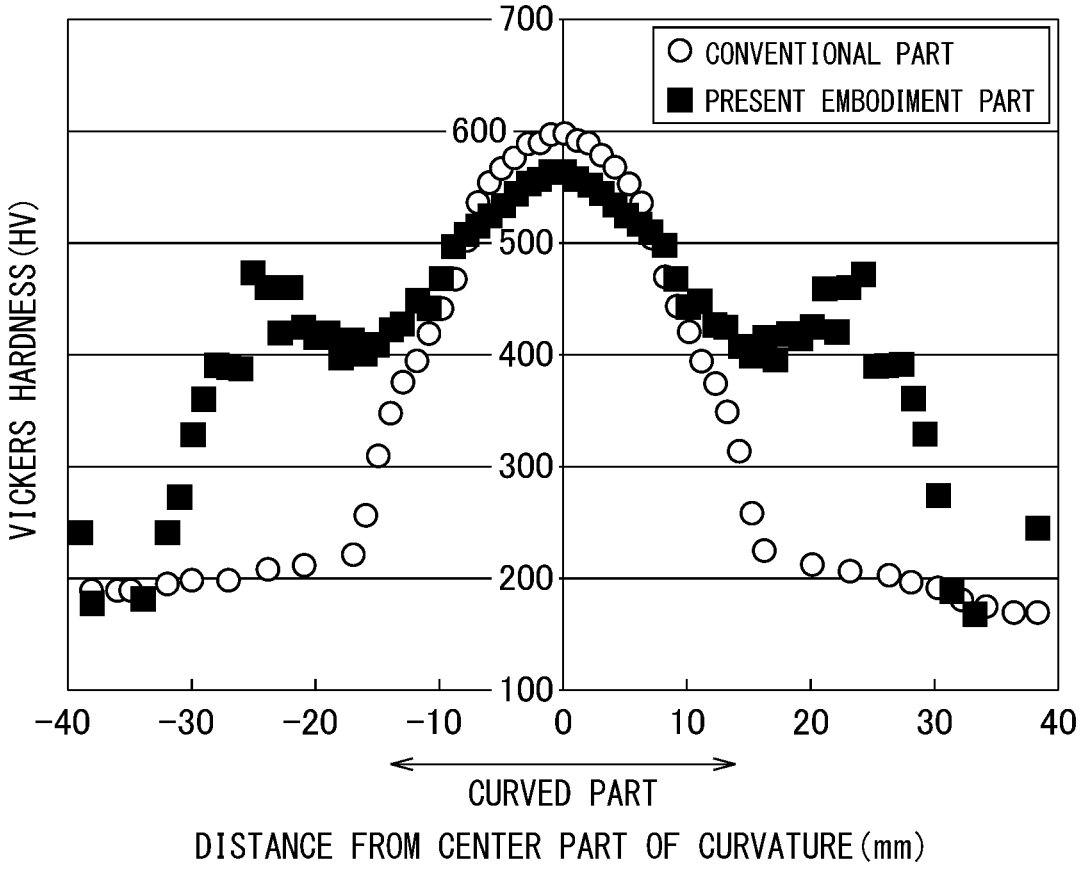
FIG. 11 is a graph relating to a conventional part and an embodiment part shown in FIGS. 10A and 10B and showing the relationship between the Vickers hardness and position in the longitudinal direction of the flange based on the center of curvature.

Next, the conventional part and embodiment part shown in FIGS. 10A and 10B were measured for the Vickers hardness of the curved center part in particular of the stretch flange part. FIG. 11 is a graph relating to the conventional part and the embodiment part shown in FIGS. 10A and 10B and showing the relationship between the Vickers hardness and longitudinal direction position of the flange based on the center of curvature. Note that, the position in the vertical direction at the position of measurement of the Vickers hardness was made a position of 1 mm below in the direction from the topmost part in the vertical direction of the stretch flange.

As clear from FIG. 11, it is learned that in the conventional part, the Vickers hardness rapidly fluctuates the further from the center of the curved part. As opposed to this, it is learned that in the embodiment part, such rapid fluctuation of the Vickers hardness is not seen. Even in a region outside of the curved part, there is a region where the Vickers hardness is still relatively high.

Here, it is known that the Vickers hardness of the top plate (nonformed part) when using a tensile strength 590 MPa class steel sheet is about 200 HV, while the Vickers hardness of the center of the curved part, as shown in FIG. 11, is 550 HV to 600 HV or so. Further, if away from the center of the curved part in the circumferential direction, the Vickers hardness decreases, but a region where a Vickers hardness larger than the Vickers hardness of the top plate part by 10 HV or more can be said to be a region where the maximum main strain of the center of the curved part has been sufficiently dispersed.

According to FIG. 11, the region in which such maximum main strain is sufficiently dispersed is limited to the range of about 15 mm from the center of curvature in the conventional part, but extends to a range of at least about 30 mm from the center of curvature in the embodiment part.

Due to the above, in the embodiment part, compared with the conventional part, it can be said that the maximum main strain is dispersed over an extremely broad range at the outside in the circumferential direction from the center of curvature of the flange. For this reason, the stretch flanging technique according to the present embodiment can be said to be art able to strikingly prevent the occurrence of cracking during working compared with the prior art.

Further, preferred embodiments of the present invention were explained, but the above embodiments are illustrations. The present invention should not be interpreted as being limited by the above embodiments. A person having ordinary knowledge in the field of art to which the present invention belongs clearly would be able to conceive of various modifications and corrections within the scope of the technical idea of the present invention.

For example, the main slanted wall part, first sub slanted wall part, and second sub slanted wall part need not be shaped symmetrical to the left and right. Further, in the above embodiments, the example of use of steel sheet as the blanks was explained, but of course the present invention is not limited to steel sheet. The present invention is art relating to press forming, so it is clear that the invention can also be applied to press formable sheets, for example, aluminum sheets or titanium sheets.

REFERENCE SIGNS LIST

1 stretch flanging tool (die)
10 top surface part
11 main slanted wall part
12*a* first sub slanted wall part
12*b* straight wall part
13*a* second sub slanted wall part
13*b* straight wall part
14 nonforming part
15 nonforming part
16 ridgeline
17 ridgeline
18 ridgeline
20 part of boundary line between main slanted wall part and straight wall part (ridgeline)
21 part of boundary line between main slanted wall part and straight wall part (ridgeline)
22 ridgeline
23 ridgeline
32 punch
34 pad
36 blank
C contact position of blank and ridgeline (center position in curved direction of blank)
c horizontal direction dimension from punch and pad to straight wall part
h horizontal direction protrusion dimension of blank from punch and pad
P distance from center position in curved direction of blank
S vertical direction dimension of slanted wall part
$\alpha$ opening angle of first ridgeline with respect to horizontal direction
$\varepsilon$ amount of strain
$\theta$ slant angle of slanted wall part with respect to vertical direction

The invention claimed is:

1. A stretch flanging tool comprising:

a top surface part having a first protruding part in a top view, straight wall parts, a main slanted wall part, the main slanted wall part positioned between the top surface part and the straight wall parts, the main slanted wall part forming an angle with the top surface part of more than 0° and less than 90° and with the straight wall parts of 10° or more and less than 90°, the main slanted wall part having two ridgelines intersecting at the straight wall part sides, a first sub slanted wall part, the first sub slanted wall part sharing one ridgeline among the two ridgelines with the main slanted wall part, the first sub slanted wall part forming angles with the top surface part and a straight wall part of more than 0° and less than 90°, and a second sub slanted wall part, the second sub slanted wall part sharing the other ridgeline among the two ridgelines with the main slanted wall part, the second sub slanted part forming angles with the top surface part and a straight wall part of more than 0° and less than 90°, wherein the straight wall portion adjacent to the main slanted wall part has a second protruding part in the top view.

2. The stretch flanging tool according to claim 1, wherein an opening angle of the two ridgelines with respect to a side shared by the main slanted wall part and the top surface part is 45 to 90°.

3. The stretch flanging tool according to claim 1, wherein an angle θ of the main slanted wall part with respect to the straight wall parts is 10 to 45°.

4. The stretch flanging tool according to claim 1, wherein a radius of curvature of the two ridgelines is 15 mm or less.

5. The stretch flanging tool according to claim 1, wherein in a front view, the two ridgelines being convex with respect to the sub slanted wall parts.

6. The stretch flanging tool according to claim 1, wherein the first sub slanted wall part and/or the second sub slanted wall part further comprises one or more ridgelines.

7. The stretch flanging tool according to claim 6, wherein the ridgeline further provided on the first sub slanted wall part and/or the second sub slanted wall part comprises intersects with the ridgeline shared by the main slanted wall part and the first sub slanted wall part or the second sub slanted wall part.

8. The stretch flanging tool according to claim 2, wherein an angle θ of the main slanted wall part with respect to the straight wall parts is 10 to 45°.

9. The stretch flanging tool according to claim 2, wherein a radius of curvature of the two ridgelines is 15 mm or less.

10. The stretch flanging tool according to claim 2, wherein in a front view, the two ridgelines being convex with respect to the sub slanted wall parts.

11. The stretch flanging tool according to claim 2, wherein the first sub slanted wall part and/or the second sub slanted wall part further comprises one or more ridgelines.

12. The stretch flanging tool according to claim 11, wherein the ridgeline further provided on the first sub slanted wall part and/or the second sub slanted wall part comprises intersects with the ridgeline shared by the main slanted wall part and the first sub slanted wall part or the second sub slanted wall part.

13. The stretch flanging tool according to claim 3, wherein a radius of curvature of the two ridgelines is 15 mm or less.

14. The stretch flanging tool according to claim 3, wherein in a front view, the two ridgelines being convex with respect to the sub slanted wall parts.

15. The stretch flanging tool according to claim 3, wherein the first sub slanted wall part and/or the second sub slanted wall part further comprises one or more ridgelines.

16. A stretch flanging method using a stretch flanging tool according to claim 1 to form a member having a stretch flange part, the stretch flanging method comprising:

a step of bending a blank along the two or more ridgelines and a step of bending the blank along ridgelines of the straight wall parts.

17. The stretch flanging method according to claim 16, wherein a vertical direction dimension S of the main slanted wall part, a slant angle θ of the main slanted wall part with respect to a vertical direction, a horizontal direction protrusion dimension "h" of the blank from the punch and pad, and a horizontal direction dimension "c" from the pad and punch satisfy the relationship:

$$S \leq (h-c)/\tan\theta.$$

18. The stretch flanging method according to claim 17, wherein an opening angle of the two ridgelines with respect to a side shared by the main slanted wall part and the top surface part is 45 to 90°.

19. The stretch flanging method according to claim 17, wherein the angle θ of the main slanted wall part with respect to the straight wall parts is 10 to 45°.

* * * * *